US005711111A

United States Patent [19]

Nyffenegger et al.

[11] Patent Number: 5,711,111

[45] Date of Patent: Jan. 27, 1998

[54] REVOLVING DOOR LOCK

[75] Inventors: Jürg Nyffenegger, Schwarzenburg, Switzerland; Erik Jan Huber, AR Purmer; Jacob Robert Alfred Huber, ES Edam, both of Netherlands

[73] Assignee: Boon Edam E.V., Edam, Switzerland

[21] Appl. No.: 406,874

[22] PCT Filed: Oct. 6, 1993

[86] PCT No.: PCT/NL93/00196

§ 371 Date: May 11, 1995

§ 102(e) Date: May 11, 1995

[87] PCT Pub. No.: WO94/08121

PCT Pub. Date: Apr. 14, 1994

[51] Int. Cl.[6] ..... E05D 15/02

[52] U.S. Cl. ..... 49/42; 49/44

[58] Field of Search ..... 49/42, 44, 68, 49/93, 94, 95, 45; 109/6, 8

[56] References Cited

U.S. PATENT DOCUMENTS

| | | | |
|---|---|---|---|
| 732,982 | 7/1903 | Wendler | 49/68 |
| 1,406,788 | 2/1922 | Weinmann | 49/42 X |
| 1,544,571 | 7/1925 | Garst | 109/8 |
| 2,029,914 | 2/1936 | Dreher | 49/44 X |
| 3,906,327 | 9/1975 | O'Callaghan et al. | 318/603 |
| 3,967,411 | 7/1976 | Ulmann | 49/68 |
| 4,358,909 | 11/1982 | Trikilis | 49/42 |
| 4,586,441 | 5/1986 | Zekich | 109/8 |
| 4,640,046 | 2/1987 | Rushford | 49/44 |
| 4,843,761 | 7/1989 | Sandling | 49/41 |

FOREIGN PATENT DOCUMENTS

| | | | |
|---|---|---|---|
| 0 296 134 | 5/1988 | European Pat. Off. . | |
| 1 438 716 | 6/1965 | France . | |
| 2 245 846 | 6/1973 | France . | |
| 3008782 | 10/1980 | Germany | 49/42 |
| 400 602 | 4/1932 | United Kingdom . | |

OTHER PUBLICATIONS

Official Gazette, Jun. 25, 1901, p. 2656, U.S. Patent 677,294 –to Theophilus Van Kannel, "Revolving Door".

*Primary Examiner*—Jerry Redman
*Attorney, Agent, or Firm*—Pennie & Edmonds LLP

[57] ABSTRACT

A revolving door lock is positioned on an inner space of the building and is sealed to the outside so that no heat energy is lost for nothing and hardly no draught appears. There is no need for three or four wings at the individual revolving doors so that with each revolving door more space is available for the passage with trolleys, wheel chairs, luggage and the like. Furthermore, the revolving door lock can be passed quickly, in that at each revolving door a free passage is possible since only one of the doors should effect a seal at a time, while the other one can be fully open. As a result, several persons may pass through the revolving door lock in their own speed without interfering with each other.

15 Claims, 5 Drawing Sheets

REVOLVING DOOR LOCK

BACKGROUND OF THE INVENTION

1. Field of the Invention:

The present invention relates to a revolving door lock having outer walls laterally defining a passage space.

2. Description of the Prior Art:

In the present times of energy saving it is important to seal off entrances of buildings as good as possible so that no heating power disappears from the building. The inner space of the building should also be kept free of draught, which is particularly important in restaurants or hotels, shops and main entrances of commercial properties, hospitals and the like. Until now, this object has been obtained by so-called revolving cross doors, in which three or four door wings define three or four cylinder segments having an angle at the center of 120° or 90° respectively. With these revolving cross doors, in particular with the four winged revolving door, the passage space is very narrow so that it is for example not possible to enter the building entrance with a trolley or a wheel chair, and the passage with suitcases is difficult. A further disadvantage of these prior art doors is that all persons passing through the revolving cross doors should go equally fast so that old or handicapped people could become pinched due to a faster person which is also in the area of the revolving cross door, or due to a motorized revolving cross door being driven too fast. Motorized revolving cross doors having a lower rotational speed have a reduced capacity, however, and prevent a quick passage through the revolving door lock.

SUMMARY OF THE INVENTION

The object of the present invention is to provide a revolving door lock which does not have said disadvantages of the prior art revolving cross doors.

For obtaining said object, the revolving door lock according to the invention is characterized by at least two revolving doors moving relatively synchronized and having two wings rotatable about respective vertical rotating axes, said wings of the different revolving doors have such relative angular position that the passage space is always closed at least on one side.

The revolving door lock according to the invention effects that, as a result, in each position of the revolving doors the inner space of the building is sealed to the outside so that no heat energy is lost for nothing and hardly no draught appears. On the other hand, there is no need for three or four wings at the individual revolving doors so that with each revolving door more space is available for the passage with trolleys, wheel chairs, luggage and the like. Furthermore, the revolving door lock can be passed quickly, in that at each revolving door a free passage is possible since only one of the doors should effect a seal at a time, while the other one can be fully open. As a result, several persons may pass through the revolving door lock in their own speed without interfering with each other.

A maximum passage space at the revolving doors is created if each revolving door comprises two aligned wings on both sides of the respective rotating axis. Then, a proper seal through the revolving door lock is always effected when two revolving doors are provided of which the angles to their own line symmetry in longitudinal direction have a relative angular off-set of 90°.

A favorable embodiment of the revolving door lock according to the invention is characterized in that the rotating axes of the revolving doors are positioned at a distance which is greater than the sum of the radius of both revolving doors, and preferably greater than 2.25 times the radius.

Due to this feature it is possible to create an intermediate space between the revolving doors offering persons passing through the revolving door lock the opportunity to stop between the revolving doors. This is of great importance to the safety as people could panic at the transfer between the revolving doors because they do not know how to walk and could then be hit by the door wings. According to the invention the people are able to reorientate in the intermediate space and only then continue on their way. With a distance of at least ±0.4 m and preferably 0.75 m between the ends of the door wings there is created enough space for persons, while for example in supermarkets where people pass through the revolving door lock with shopping trolleys a room of at least 1.5 m provides a place to stop. This intermediate space also enables a continued passage between the revolving doors to both quickly and slowly passing people which may enter the next revolving door just before or just after the passage of a door wing. On the other hand, the feature offers new arrangement possibilities of the revolving doors. It is for instance possible to connect three or more revolving doors to the intermediate or passage space, which are adapted to each other and together effect the sealing of the inner space of the building.

Embodiments of the invention by way of example are elucidated hereafter with reference to the attached drawings.

DESCRIPTION OF THE PREFERRED EMBODIMENT

Figure 1:
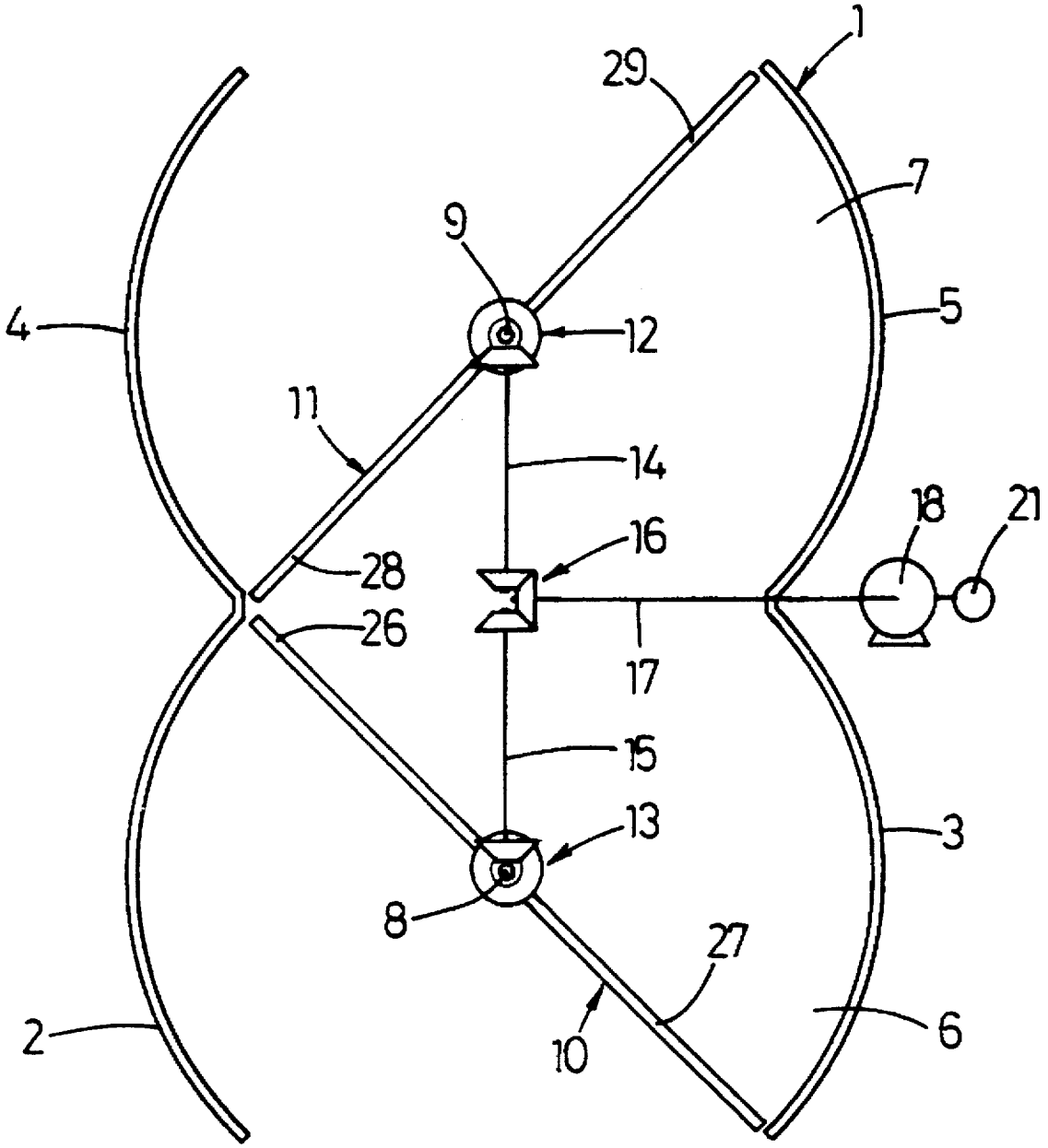
FIG. 1 is a very schematic plan view of a first embodiment of the revolving door lock and drive, FIGS. *2a–2d* shows four different positions of the revolving doors within the revolving door lock of FIG. 1.

In the various figures similar parts are indicated by the same reference numerals.

The revolving door lock 1 according to FIG. 1–4 includes four outer walls 2, 3, 4, 5 each forming a part of a cylindrical casing, the outer walls 2 and 3 for example forming an entrance or exit space 6 on the side of the street and the outer walls 4 and 5 defining an entrance or exit space 7 on the inner side of a building. The pairs of outer walls 2, 3 and 4, 5, respectively, are diametrically opposed and extend through an angle of 90°. The vertical central shafts 8 and 9 of the space 6, 7 form rotating axes for the revolving doors 10 and 11. Each revolving door 10 and 11 consists of two door wings 26, 27 and 28, 29, respectively, positioned on both sides of the rotating axis 8, 9 and each pair being mutually aligned. Of course, the door wings 26, 27 and 28, 29 could be integral. At the upper side of the revolving doors 10 and 11 there is disposed on the respective rotating shafts 8 and 9 and within a gear box a gear 12, 13, respectively, including bevel gearing wheels. Drive shafts 14 and 15 are connected to the gears 12 and 13 and being commonly driven through a bevelled gear transmission 16 by a driving shaft 17 which is rotated by a drive system 18. The drive system 18 is controlled by a control device 21.

Figure 2:
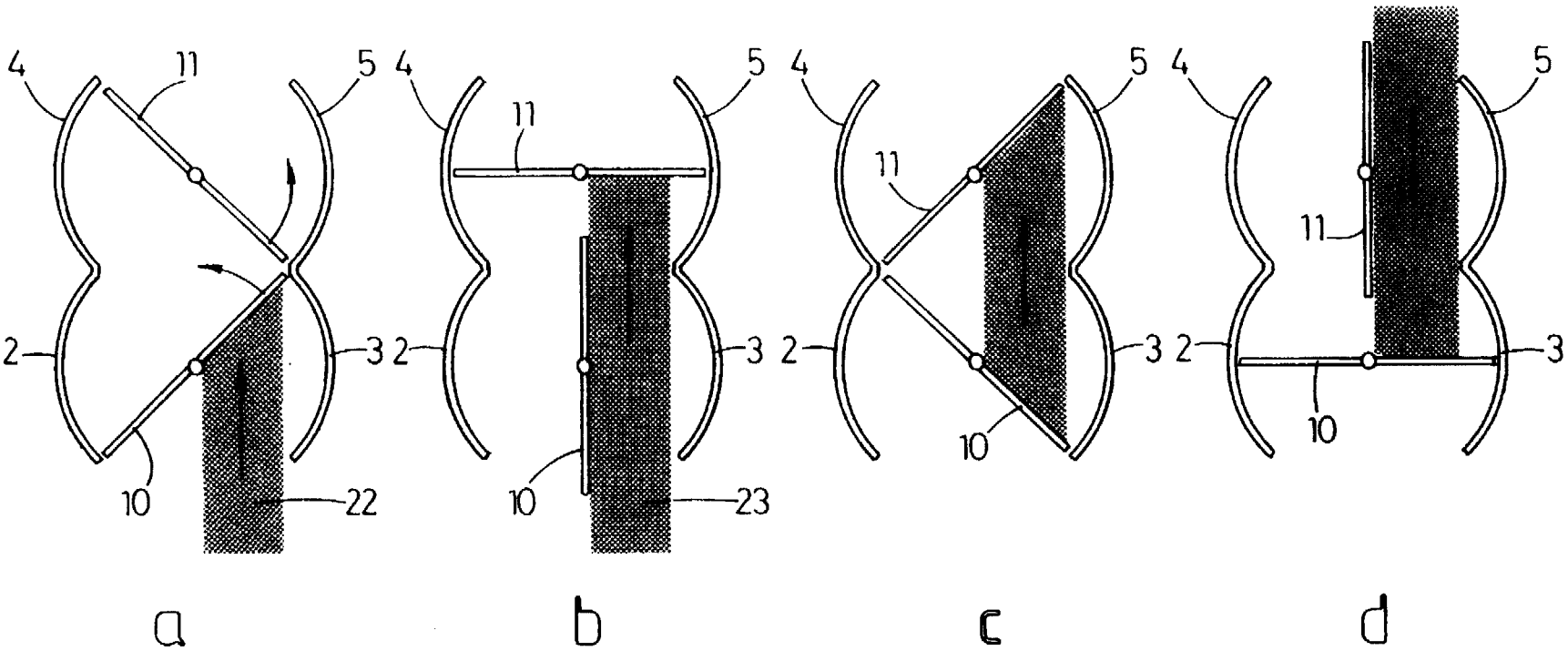

In FIG. 2, four positions of the revolving doors 10 and 11 are illustrated. Interrupted lines illustrate the free passage space 22, 23, 24, 25, respectively, through the passage lock. In front of the passage lock there is a movement sensor activating the drive of the revolving doors as soon as a person approaches the passage lock. Contrary to conventional revolving doors in which two revolving doors are positioned perpendicularly and include a common rotating axis, the revolving door lock according to the invention does not offer only a cylindrical segment of 90° as passage space, but a longer area, which better enables the passage with a trolley, in a wheel chair or with suitcases.

The revolving doors preferably move at one revolution per minute in idle operation in which the drive is switched off when there is a rest position without movement sensing. In operation, the number of revolutions per minute is preferably five and after circa 15 seconds without sensing movements there is a switch to the idle operation.

The dotted area 23 according to FIG. 2*b* illustrates that already in this position the passage space is wide open. In the position of FIG. 2*c*, the entrance door 10 is closing, wherein, however, the passage is not urged from behind contrary to conventional revolving crosses. In the position of FIG. 2*d*, the entrance to the interior of the building is released and one can quickly continue its passage and no urge from behind is created.

Figure 3:
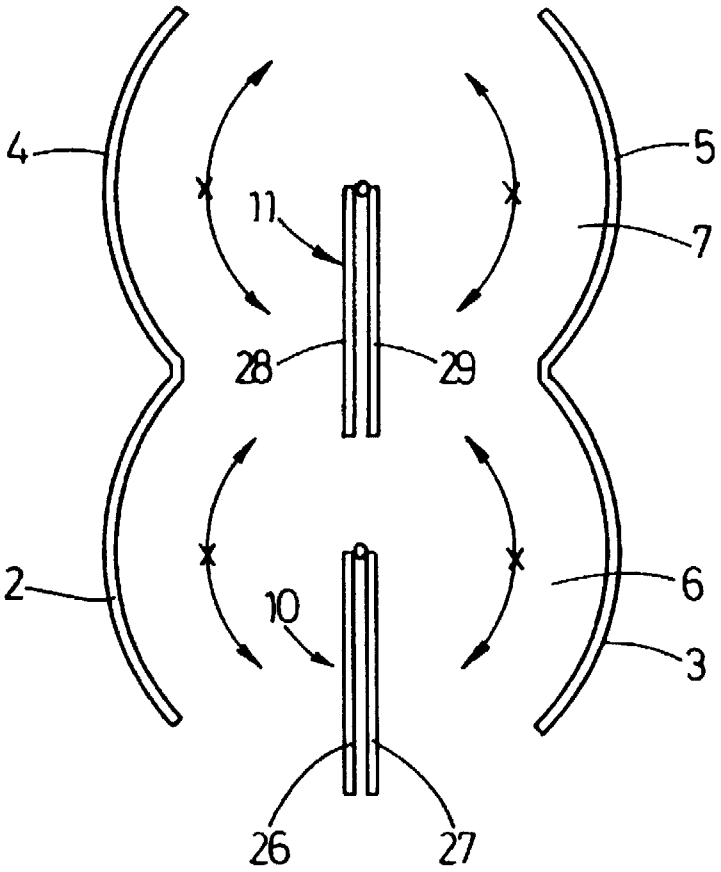
FIG. 3 shows the revolving door lock of FIG. 1 with the revolving doors in an emergency position.

In FIG. 3 the revolving door lock is shown in a position of the revolving doors 10 and 11 as can be used for example in the case of an emergency. Both revolving doors 10 and 11 are hingedly supported in which both wings 26, 27 and 28, 29, respectively, of both revolving doors 10 and 11 may be hinged towards each other. All four wings of both revolving doors 10 and 11 are then aligned so that there is created a maximum passage space 6, 7 through the revolving door lock.

In the hinged bearing support of the revolving doors 10 and 11, the wings 26, 27 and 28, 29, respectively, are pivotally attached to the respective shafts 8 and 9 so that they can be relatively hinged after they are unlocked.

Figure 4:
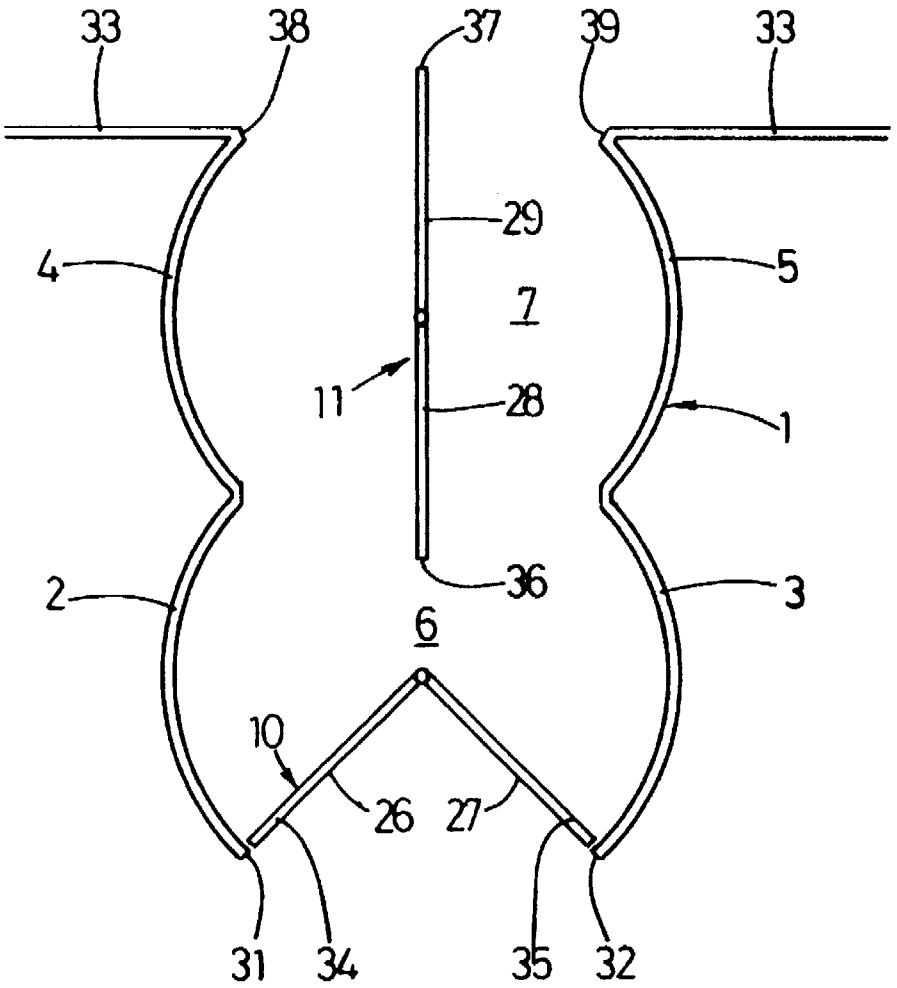
FIG. 4 shows the revolving door lock of FIG. 1 with the outer revolving doors in the night position.

In FIG. 4, the passage lock is shown in its closed position. Then, both wings 26 and 27 of the outer revolving door 10 are hinged outwardly and are closed to the ends 31 and 32 of both outer walls 2 and 3. The revolving door 11 is then preferably in a position perpendicular to the building wall 33. The passage spaces 6 and 7 of the revolving door lock 1 may then be used in this position for entrance purposes during the night or in weekends.

The sealing of the ends 34 and 35, and 36 and 37, respectively, of the revolving doors 10 and 11 to the inner side of the outer walls 2, 3, 4 and 5 of the revolving door lock is effected, for example, by means of vertical brushes attached to the revolving door ends. To the outer ends 31, 32 and 38, 39, respectively, of the outer walls 2, 3, 4 and 5 of the revolving door lock, there could be arranged pneumatic or electric safety pressure strips, for example. In principle, all main and secondary closing edges are secured in accordance with the regulations and the state of the art. In case there is too much force active between the ends of the revolving doors and the ends of the outer walls which may cause a risk of injury, the safety pressure strip is activated and the drive system of the revolving doors is switched off. If the wings are hingedly arranged, then also the wing may hinge back by this force and the driving force is interrupted until the wing is hinged back to its original position.

Figure 5:
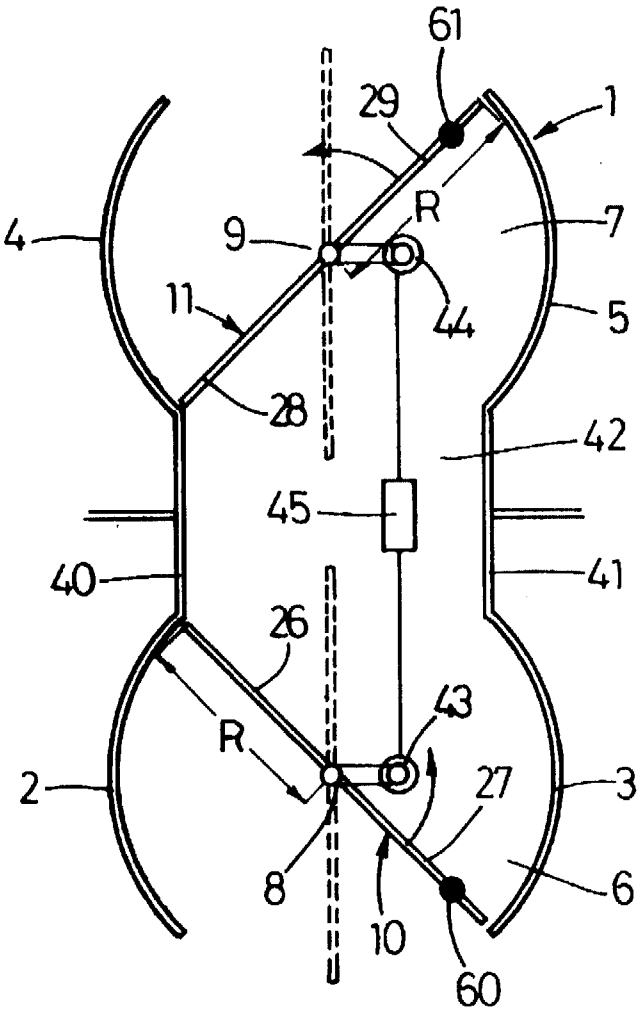
FIG. 5 is a schematic plan view of a second embodiment of the revolving door lock according to the invention illustrating a so-called summer position with interrupted lines.

FIG. 5 shows a second embodiment of the revolving door lock according to the invention, in which there is arranged an intermediate part 40, 41, respectively, between the outer walls 2, 4 and 3, 5, respectively, so that there is created an intermediate space 42 between the revolving doors 10 and 11. As a result, the rotating axes 8 and 9 of the revolving doors 10 and 11 are positioned at a distance to each other which is greater than the sum of the radius R of both revolving doors 10 and 11 of which the radia R are equal in this case. Due to this feature, the paths of both revolving doors 10 and 11 do not overlap as in the first embodiment of FIGS. 1–4, and there is even created an intermediate space enabling a person to wait within the intermediate space 42 before continuing its way. In a passage lock having revolving doors the diameter of which being 3 m, the intermediate space between the ends of the door wings may for example be 0.75 m in passages for persons and 1.5 m in passages for persons having shopping trolleys.

Furthermore, each revolving door 10, 11 in this embodiment has its own drive motor 43, 44 which are electronically coupled through a synchronizing device 45 ensuring the synchronized rotation of the revolving doors 10, 11. Such embodiment in which the synchronized rotation of the revolving doors 10, 11 is obtained through a synchronizing device has the important advantage that each drive motor 43, 44 drives a smaller mass resulting in an enhanced safety due to a smaller mass inertia.

Figure 7:
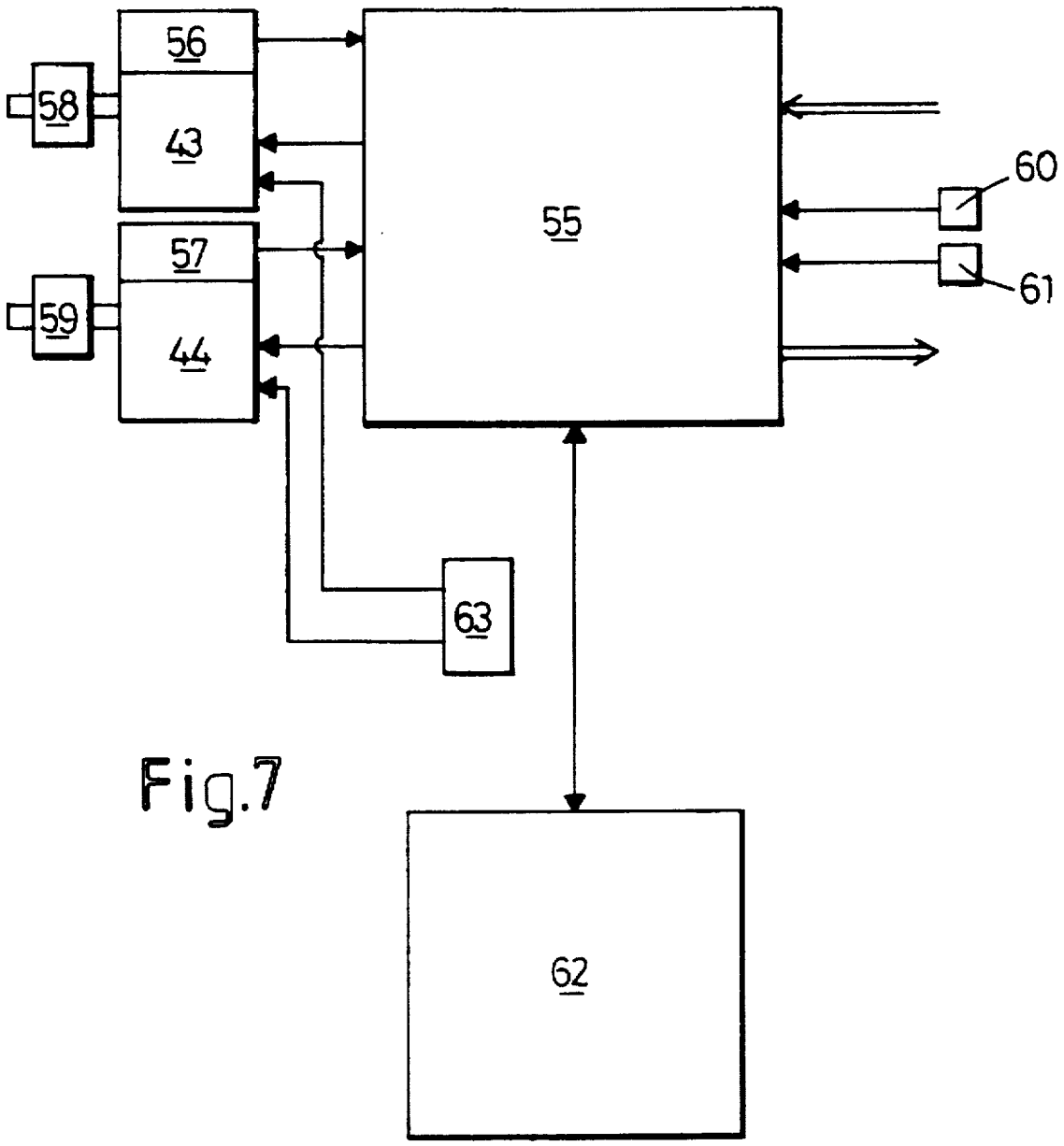
FIG. 7 is a substantially simplified block diagram of a synchronizing device of the embodiment of FIG. 5.

A substantially simplified block diagram of the synchronizing device 45 is shown in FIG. 7. The synchronizing device 45 includes a central processing unit 55 controlling the drive motors 43 and 44. Each drive motor 43, 44 comprises a respective so-called incremental angular encoder 56, 57, respectively, which is coupled directly to the shaft of the drive motor and which delivers a certain number of pulses for each revolution of the motor shaft. The drive motors 43, 44 drive the rotating shafts 8, 9 through a reduction gear 58, 59 so that, by means of an angular encoder having a relatively small resolution, nonetheless a great number of pulses per revolution of the revolving door and consequently a high resolution for determining the position of the revolving door is obtained. The counter position of each angular encoder 56, 57, which counter position indicates the rotational position of the respective revolving door 10, 11, is supplied to the processing unit 55.

Furthermore, a position detector 60, 61 for each revolving door is mounted in a fixed position relative to the respective revolving door 10, 11, respectively. As is shown in FIG. 5, the fixed position of the position detector 60 is offset 90° with respect to the fixed position of the position detector 61. Both position detectors 60, 61 are also connected to the processing unit. Each position detector 60, 61 is able to deliver a signal each 180° or each 360°, dependent on the fact whether one or both door wings comprise for example a magnetic element which is detected by the position detector 60, 61.

Finally, the processing unit 55 is connected to a conventional control unit (not shown) or a revolving door which is adapted a.o. to deliver a rotation command to the processing unit. When the processing unit 55 receives a rotation command, the processing unit activates the drive motors 43, 44 and causes the revolving doors 10, 11 to rotate in a synchronized fashion with a speed adjustable through a control panel 62, by means of the signals of the angular encoders 56, 57 and the position detectors 60, 61. The processing unit 55 resets the counter position of each angular encoder to a starting position, preferably the zero position, each time the respective position detector 60, 61 monitors a door wing 26 or 27 and consequently when a particular rotational position is reached. As a result, the processing unit 55 may obtain the synchronized rotation of the revolving doors 10, 11 by equalizing the counter positions of both angular encoders 56, 57. Maintaining the difference in angular position of 90° between the revolving doors 10, 11 is very simple due to the relative 90° off-set of both position detectors 60, 61.

If the processing unit 55 signalizes a lack of synchronization of the revolving doors 10, 11, the synchronized rotation of the revolving doors is restored by the processing unit by braking the leading revolving door until the revolving doors are synchronized again. Consequently, no unsafe situations will occur as a result of a sudden acceleration of a revolving door.

It will be clear that when there is a lack of synchronization, both the revolving door 10 and the revolving door 11 may be the leading revolving door. In the synchronizing device 45 there is no master-slave situation which is common in synchronizing systems. Both revolving doors 10, 11 can be master and slave for the synchronizing device.

As in normal operation the processing unit 55 receives signals both from the angular encoders 56, 57 and from the position detectors 60, 61, the processing unit 55 can easily check the proper operation of the angular encoders 56, 57 and the position detectors 60, 61. If, after a full revolution, no signal is received from a position detector 60, 61, the processing unit 55 delivers an alarm signal through the control panel 62 in which, for example by means of individual LED's (not shown), the defective position detector is indicated. The processing unit 55 keeps the drive motors 43, 44 in operation and strives to maintain the synchronized rotation by means of the signals of the angular encoders 56, 57. For reasons of safety, the processing unit 55 may select a lower rotational speed, for example.

If no signal from an angular encoder 56, 57 is received, the processing unit 55 also delivers an alarm signal through the control panel 62 in which the defective angular encoder 56, 57 is indicated by a LED. In case of a defective angular encoder 56, 57, the processing unit 55 may strive to maintain a synchronized rotation by means of the position detectors 60, 61. Alternatively, it is possible to stop the drive motors of the defective angular encoder 56, 57 and to release the respective revolving door to allow for manual operation.

If the synchronizing device 45 is connected to the voltage of the supply line for the first time or if the processing unit 55 is reset, the processing unit 55 controls the drive motors 43, 44 such that the revolving doors 10, 11 are rotated to the particular position determined by the respective position detector 60, 61 at a creeping speed to determine the starting positions of the angular encoders 56, 57. Then, the revolving doors 10, 11 are accelerated and decelerated again for a short time, enabling the processing unit 55 to determine from the motor current the mass driven by the drive motors. With this information, the processing unit 55 is able to limit the maximum torque of the revolving doors 10, 11 to a value laid down in safety regulations.

The synchronizing device 45 further includes an emergency stop device 63 directly connected to the drive motors 43, 44 and stopping and short-circuiting the drive motors in case of an emergency stop.

By using the synchronizing device 45 including a drive motor 43, 44 for each revolving door 10, 11 it is possible to simply set the revolving doors in certain particular positions. In FIG. 5, for example, interrupted lines indicate a so-called summer position of the revolving door lock 1 in which the revolving doors 10, 11 are positioned individually and aligned with each other along the longitudinal axis of the revolving door lock 1. The doors 10, 11 not only open the passage but also simultaneously form a separation of the entrance and exit paths. This position may also be used for the transport of goods occupying a lot of space.

It is also possible to select a night position through the control panel 62, in which the revolving door 11 is in its summer position indicated by an interrupted line, while the revolving door 10 is perpendicular to the summer position, for example.

Figure 6:
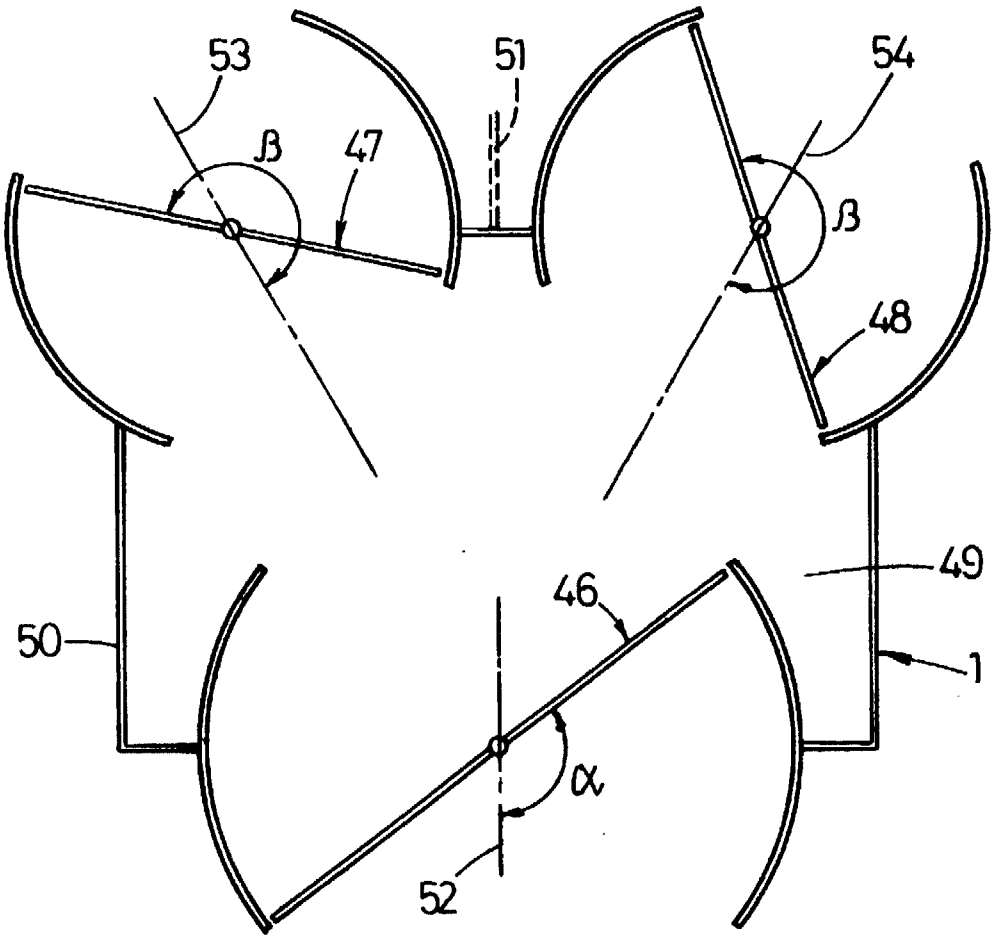
FIG. 6 is a very schematic plan view of a third embodiment of the revolving door lock according to the invention.

FIG. 6 shows a further embodiment in which the revolving door lock 1 comprises three revolving doors, that is a single outer revolving door 46 and two inner revolving doors 47 and 48. Between the revolving doors there is a central passage space 49 defined by the revolving doors 46–48 and by the outer walls 50. Such revolving door lock may for example be used for the entrance and exit of two interior spaces separated by a partition wall 51, and it is also possible that the revolving door 46 having a large capacity is used for both entrance and exit, while the smaller revolving doors 47 and 48 are used as entrance on the one hand and as exit on the other hand. In this embodiment, the vertical planes of symmetry 52, 53 and 54 in the longitudinal directions of the revolving doors 46, 47, 48, respectively, are not parallel to each other. Nonetheless, the angles $\beta$ of the revolving doors 47 and 48 to their respective longitudinal plane 53, 54 are off-set 90° with respect to the angle $\alpha$ of the revolving door 46 with respect to its longitudinal plane 52. In this way it is ensured that either the revolving door 46 or the revolving doors 47 and 48 are in their closed position thereby preventing draught through the revolving door lock. Of course, also other arrangements of a larger or smaller number of revolving doors may be selected within a revolving door lock depending on the respective situation.

The invention is not restricted to the embodiments shown in the drawing and described herein before which may be varied in different manners within the scope of the invention defined in the claims.

We claim:

1. A revolving door lock having outer walls laterally defining a passage space, comprising at least two revolving doors coupled for relatively synchronous movement and each having two wings rotatable about respective vertical rotating axes of the revolving doors, with an angle of said wings of the revolving doors with respect to a line of symmetry in a longitudinal direction being an angular off-set of 90° so that the passage space with respect to the line of symmetry also has an angular off-set of 90° and the passage space is always closed at least on one side, wherein the rotating axes of the revolving doors are positioned at a distance which is at least about 2.25 times greater than the radius of one of the revolving doors to create an intermediate space between the revolving doors which is sufficiently large enough for a person to stand therein without interference from the revolving doors.

2. Revolving door lock according to claim 1, wherein the wings of the revolving doors are relatively pivotable back and forth about the respective rotating axis.

3. Revolving door lock according to claim 1, wherein the revolving doors are driven by means of a single motor being connected to revolving door shafts by a mechanical coupling.

4. Revolving door lock according to claim 1, wherein each revolving door is equipped with its own drive motor, the drive motors being coupled by an electric synchronizing device.

5. A revolving door lock of claim 1, wherein the passage space is further defined by a single entrance adjacent one of the revolving doors and a single exit adjacent another of the revolving doors.

6. A revolving door lock of claim 1, wherein the intermediate space is 0.75 meters in length.

7. A revolving door lock having outer walls laterally defining a passage space, comprising three or more revolving doors with at least two revolving doors coupled for relatively synchronous movement and each having two wings rotatable about respective vertical rotating axes of the revolving doors, with an angle of said wings of the revolving doors with respect to a line of symmetry in a longitudinal direction being an angular off-set of 90° so that the passage space with respect to the line of symmetry also has an angular off-set of 90° and the passage space is always closed at least on one side, wherein the rotating axes of the revolving doors are positioned at a distance which is greater than the sum of the radius of both revolving doors to create an intermediate space between the revolving doors which is sufficiently large enough for a person to stand therein without interference from the revolving doors; the revolving doors being positioned between the outer walls of a larger passage space.

8. A revolving door lock having outer walls laterally defining a passage space, comprising at least two revolving doors coupled for relatively synchronous movement and each having two wings rotatable about respective vertical rotating axes of the revolving doors, with an angle of said wings of the revolving doors with respect to a line of symmetry in a longitudinal direction being an angular off-set of 90° so that the passage space with respect to the line of symmetry also has an angular off-set of 90° and the passage space is always closed at least on one side, wherein the rotating axes of the revolving doors are positioned at a distance which is greater than the sum of the radius of both revolving doors to create an intermediate space between the revolving doors which is sufficiently large enough for a person to stand therein without interference from the revolving doors, with a synchronizing device for each revolving door comprising an angular encoder delivering a certain number of pulses for each revolution of a respective revolving door so that a counter position indicates a rotational position of the respective revolving door, and at least one position detector for detecting at least one particular revolving position of the respective revolving door, wherein a processing unit is provided to which the angular encoder and the position detector is connected and which controls drive motors, said processing unit resets the counter position of the angular encoder to a starting position when the at least one position detector signalizes that a particular rotating position is reached, and said processing unit is adapted to allow the revolving doors to move with a synchronized adjustable speed by means of the angular encoder and the at least one position detector.

9. Revolving door lock according to claim 8, characterized in that a first position detector of the at least one position detector on one side of the revolving door lock is arranged in a fixed position relative to the respective revolving door, which is rotated 90° with respect to a fixed position taken by a second position detector of the at least one position detector on an opposite side of the revolving door lock relative to the respective revolving door, and the processing unit controlling the drive motors such that the angular encoders indicate identical revolving door positions.

10. Revolving door lock according to claim 8, wherein, in an event that the revolving doors become out of synchronization, the processing unit brakes a leading revolving door of the revolving doors to restore synchronization.

11. Revolving door lock according to claim 8, characterized in that the processing unit monitors a presence of signals from the angular encoder and the at least one of the position detector and delivers an alarm signal if the at least one of the position detector does not deliver a signal after a revolution of the revolving doors, wherein the processing unit preferably maintains a synchronized rotation of the revolving doors at a lower speed by means of the signals from the angular encoder.

12. Revolving door lock according to claim 11, characterized in that the processing unit also delivers an alarm signal if the signal from the angular encoder disappears, wherein preferably at least the respective revolving door is stopped and released.

13. Revolving door lock according to claim 8, characterized in that, upon switching to one of a voltage of a supply line and upon resetting the processing unit, the processing unit controls the drive motors such that the revolving doors are moved to a rotational position determined by the position detector at a creeping speed, wherein, after reaching this rotational position, the processing unit accelerates and decelerates the revolving doors for a short time to determine a mass driven by the drive motors.

14. Revolving door lock according to claim 8, characterized in that an emergency stop device is provided being directly connected to the drive motors so that the emergency stop device short circuits the drive motors in case of an emergency.

15. Revolving door lock according to claim 8, characterized in that each angular encoder is coupled directly to a shaft of a respective one of the drive motors and the respective drive motor is driving the respective revolving door through a reduction gear.

* * * * *

UNITED STATES PATENT AND TRADEMARK OFFICE
CERTIFICATE OF CORRECTION

PATENT NO. : 5,711,111

DATED : January 27, 1998

INVENTORS : Nyffenegger et al.

It is certified that error appears in the above-identified patent and that said Letters Patent is hereby corrected as shown below:

Title page, item

[73] Assignee: after "Boon Edam E.V., Edam, Switzerland" insert --and Gilgen AG, Schwarzenburg, Switzerland--.

Signed and Sealed this

Second Day of June, 1998

*Attest:*

Bruce Lehman

BRUCE LEHMAN

*Attesting Officer*

*Commissioner of Patents and Trademarks*